US006351731B1

(12) United States Patent
Anderson et al.

(10) Patent No.: US 6,351,731 B1
(45) Date of Patent: Feb. 26, 2002

(54) ADAPTIVE FILTER FEATURING SPECTRAL GAIN SMOOTHING AND VARIABLE NOISE MULTIPLIER FOR NOISE REDUCTION, AND METHOD THEREFOR

(75) Inventors: David V. Anderson, Alpharetta; Stephen McGrath, Atlanta; Kwan Truong, Lilburn, all of GA (US)

(73) Assignee: Polycom, Inc., Milpitas, CA (US)

( * ) Notice: Subject to any disclaimer, the term of this patent is extended or adjusted under 35 U.S.C. 154(b) by 0 days.

(21) Appl. No.: 09/371,306

(22) Filed: Aug. 10, 1999

Related U.S. Application Data

(60) Provisional application No. 60/097,402, filed on Aug. 21, 1998.

(51) Int. Cl.[7] ..... G10L 11/02
(52) U.S. Cl. ..... 704/233; 704/225; 704/226
(58) Field of Search ..... 704/233, 225, 704/226, 227, 210; 379/390, 410

(56) References Cited

U.S. PATENT DOCUMENTS

| | | | | |
|---|---|---|---|---|
| 3,803,357 A | | 4/1974 | Sacks | |
| 4,357,491 A | | 11/1982 | Daaboul et al. | |
| 4,630,304 A | | 12/1986 | Borth et al. | |
| 4,672,669 A | | 6/1987 | DesBlache et al. | |
| 4,811,404 A | | 3/1989 | Vilmur et al. | |
| 5,012,519 A | | 4/1991 | Adlersberg et al. | |
| 5,459,814 A | | 10/1995 | Gupta et al. | |
| 5,577,161 A | | 11/1996 | Ferrigno | |
| 5,617,508 A | | 4/1997 | Reaves | |
| 5,668,927 A | | 9/1997 | Chan et al. | |
| 5,768,473 A | * | 6/1998 | Eatwell et al. | 704/226 |
| 5,774,847 A | | 6/1998 | Chu et al. | |
| 5,819,217 A | | 10/1998 | Raman | |

(List continued on next page.)

OTHER PUBLICATIONS

Article "Robust Noise Detection for Speech Detection and Enhancement" by Garner et al., published in *Electronics Letters* Feb. 13, 1997, vol. 33, No. 4, pp. 270–271.

Article "Speech Enhancement Based on Audible Noise Suppression" by Tsoukalas et al., published in *IEEE Transactions on Speech and Audio Processing*, Nov., 1997, vol. 5, No. 6, pp. 497–514.

Article "Speech Enhancement Using a Minimum Mean–Square Error Short–Time Spectral Amplitude Estimator" by Ephraim et al., published in *IEEE Transactions on Acoustics, Speech, and Signal Processing*, Dec., 1984, vol. ASSP–32, No. 6, pp. 1109–1121.

(List continued on next page.)

*Primary Examiner*—William Korzuch
*Assistant Examiner*—Daniel Abebe
(74) *Attorney, Agent, or Firm*—Needle & Rosenberg PC

(57) ABSTRACT

An adaptive filter is provided featuring a speech spectrum estimator receiving as input an estimated spectral magnitude signal for a time frame of the input signal and generating an estimated speech spectral magnitude signal representing estimated spectral magnitude values for speech in a time frame. A spectral gain generator receives as input the estimated spectral magnitude signal and the estimated speech spectral magnitude signal and generates as output an initial spectral gain signal that yields an estimate of speech spectrum in a time frame of the input signal when the initial spectral gain signal is applied to the spectral signal. A spectral gain modifier receives as input the initial spectral gain signal and generates a modified gain signal by limiting a rate of change of the initial spectral gain signal with respect to the spectral gain over a number of previous time frames. The modified gain signal is then applied to the spectral signal, which is then converted to its time domain equivalent. The value of the noise multiplier is larger when a time frame of the input signal contains more noise than speech and is smaller when a time frame of the input signal contains more speech than noise.

7 Claims, 4 Drawing Sheets

U.S. PATENT DOCUMENTS

| | | | | | |
|---|---|---|---|---|---|
| 5,825,754 | A | * | 10/1998 | Williams | 370/290 |
| 5,907,624 | A | * | 5/1999 | Takada | 381/94.2 |
| 5,943,429 | A | | 8/1999 | Händel | |
| 6,044,341 | A | * | 3/2000 | Takahashi | 704/226 |
| 6,088,668 | A | * | 7/2000 | Zack | 704/225 |
| 6,108,610 | A | * | 8/2000 | Winn | 702/77 |
| 6,122,610 | A | | 9/2000 | Isabelle | |
| 6,144,937 | A | * | 11/2000 | Ali | |
| 6,154,721 | A | | 11/2000 | Sonnic | |
| 6,160,886 | A | | 12/2000 | Romesburg et al. | |

OTHER PUBLICATIONS

Article "Elimination of the Musical Noise Phenomenon with the Ephraim and Malah Noise Suppressor" by Olivier Cappe, published in *IEEE Transactions on Speech and Audio Processing*, Apr., 1994, vol. 2, No. 2, pp. 345–349.

Article "New Methods for Adaptive Noise Suppression" by Arslan et al., published in *IEEE*, 1995, pp. 812–815.

Article "Suppression of Acoustic Noise in Speech Using Spectral Subtraction" by Steven F. Boll, published *IEEE Transactions on Acoustics, Speech, And Signal Processing*, Apr., 1979, vol. ASSP–27, No. 2, pp. 113–120.

Article "ITU–T Recommendation G.729 Annex B: A Silence Compression Scheme for Use with G.729 Optimized for V.70 Digital Simultaneous Voice and Data Applications" by Benyassine et al., published *IEEE Communications Magazine*, Sep., 1997, pp. 64–73.

Article "Speech Enhancement Based on Masking Properties of the Auditory System" by Nathalie Virag, published *IEEE*, 1995, pp. 796–799.

* cited by examiner

ADAPTIVE FILTER FEATURING SPECTRAL GAIN SMOOTHING AND VARIABLE NOISE MULTIPLIER FOR NOISE REDUCTION, AND METHOD THEREFOR

This application claims priority to U.S. Provisional Application No. 60/097,402 filed Aug. 21, 1998, entitled "Versatile Audio Signal Noise Reduction Circuit and Method".

BACKGROUND OF THE INVENTION

This invention relates to a system and method for detecting speech in a signal containing both speech and noise and for removing noise from the signal.

In communication systems it is often desirable to reduce the amount of background noise in a speech signal. For example, one situation that may require background noise removal is a telephone signal from a mobile telephone. Background noise reduction makes the voice signal more pleasant for a listener and improves the outcome of coding or compressing the speech.

Various methods for reducing noise have been invented but the most effective methods are those which operate on the signal spectrum. Early attempts to reduce background noise included applying automatic gain to signal subbands such as disclosed by U.S. Pat. No. 3,803,357 to Sacks. This patent presented an efficient way of reducing stationary background noise in a signal via spectral subtraction. See also "Suppression of Acoustic Noise in Speech Using Spectral Subtraction," *IEEE Transactions On Acoustics, Speech and Signal Processing,* pp. 1391–1394, 1996.

Spectral subtraction involves estimating the power or magnitude spectrum of the background noise and subtracting that from the power or magnitude spectrum of the contaminated signal. The background noise is usually estimated during noise only sections of the signal. This approach is fairly effective at removing background noise but the remaining speech tends to have annoying artifacts, which are often referred to as "musical noise." Musical noise consists of brief tones occurring at random frequencies and is the result of isolated noise spectral components that are not completely removed after subtraction. One method of reducing musical noise is to subtract some multiple of the noise spectral magnitude (this is referred to as spectral oversubtraction). Spectral oversubtraction reduces the residual noise components but also removes excessive amounts of the speech spectral components resulting in speech that sounds hollow or muted.

A related method for background noise reduction is to estimate the optimal gain to be applied to each spectral component based on a Wiener or Kalman filter approach. The Wiener and Kalman filters attempt to minimize the expected error in the time signal. The Kalman filter requires knowledge of the type of noise to be removed and, therefore, it is not very appropriate for use where the noise characteristics are unknown and may vary.

The Wiener filter is calculated from an estimate of the speech spectrum as well as the noise spectrum. A common method of estimating the speech spectrum is via spectral subtraction. However, this causes the Wiener filter to produce some of the same artifacts evidenced in spectral subtraction-based noise reduction.

The musical or flutter noise problem was addressed by McAulay and Malpass (1980) by smoothing the gain of the filter over time. See, "Speech Enhancement Using a Soft-Decision Noise Suppression Filter", *IEEE Transactions on Acoustics, Speech, and Signal Processing* 28(2): 137–145. However, if the gain is smoothed enough to eliminate most of the musical noise, the voice signal is also adversely affected.

Other methods of calculating an "optimal gain" include minimizing expected error in the spectral components. For example, Ephraim and Malah (1985) achieve good results, which are free from musical noise artifacts, by minimizing the mean-square error in the short-time spectral components. See, "Speech Enhancement Using a Minimum Mean-Square Error Log-Spectral Amplitude Estimator", *IEEE Transactions on Acoustics, Speech, and Signal Processing ASSP*-33 (2): 443–445. However, their approach is much more computationally intensive than the Wiener filter or spectral subtraction methods. Derivative methods have also been developed which use look-up tables or approximation functions to perform similar noise reduction but with reduced complexity. These methods are disclosed in U.S. Pat. Nos. 5,012,519 and 5,768,473.

Also known is an auditory masking-based technique for reducing background signal noise, described by Virag (1995) and Tsoukalas, Mourjopoulos and Kokkinakis (1997). See, "Speech Enhancement Based On Masking Properties Of The Auditory System," *Proceedings of the International Conference on Acoustics, Speech and Signal Processing,* Vol. 1, pp. 796–799; and "Speech Enhancement Based On Audible Noise Suppression", *IEEE Transactions on Speech and Audio Processing* 5(6): 497–514. That technique requires excessive computation capacity and they do not produce the desired amount of noise reduction.

Other methods for noise reduction include estimating the spectral magnitude of speech components probabilistically as used in U.S. Pat. Nos. 5,668,927 and 5,577,161. These methods also require computations that are not performed very efficiently on low-cost digital signal processors.

Another aspect of the background noise reduction problem is determining when the signal contains only background noise and when speech is present. Speech detectors, often called voice activity detectors (VADs), are needed to aid in the estimation of the noise characteristics. VADs typically use many different measures to determine the likelihood of the presence of speech. Some of these measures include: signal amplitude, short-term signal energy, zero crossing count, signal to noise ratio (SNR), or SNR in spectral subbands. These measures may be smoothed and weighted in the speech detection process. The VAD decision may also be smoothed and modified to, for example, hang on for a short time after the cessation of speech.

In summary, there are methods for reducing noise in speech which are efficient and simple but which produce excessive artifacts. There are also methods which do not produce the musical artifacts but which are computationally intensive. What is needed is an efficient, low-delay method of removing background noise from speech that produces few or no artifacts.

SUMMARY OF THE INVENTION

The present invention is directed to a system and method for removing noise from a signal containing speech (or a related, information carrying signal) and noise. The input signal is a voice signal corrupted by added noise, and the output is the speech signal with the added noise reduced. According to the present invention, an adaptive filter is provided featuring a speech spectrum estimator receiving as input an estimated spectral magnitude signal for a time frame of the input signal and generating an estimated speech spectral magnitude signal representing estimated spectral magnitude values for speech in a time frame. A spectral gain generator receives as input the estimated spectral magnitude signal and the estimated speech spectral magnitude signal and generates as output an initial spectral gain signal that yields an estimate of speech spectrum in a time frame of the input signal when the initial spectral gain signal is applied to the spectral signal. A spectral gain modifier receives as input the initial spectral gain signal and generates a modified gain signal by limiting a rate of change of the initial spectral gain signal with respect to the spectral gain over a number of previous time frames. The modified gain signal is then applied to the spectral signal, which is then converted to its time domain equivalent.

In addition, the present invention is directed to a system and method for filtering an input signal comprising a digitally sampled audio signal containing speech and added noise, featuring the use of a variable noise multiplier. The noise multiplier is controlled based on a measure of whether speech is present in a time frame. The value of the noise multiplier is controlled to be a larger value when a time frame of the input signal contains more noise than speech and is controlled to be a smaller value for the noise multiplier when a time frame of the input signal contains more speech than noise.

The above and other objects and advantages of the present invention will become more readily apparent when reference is made to the following description taken in conjunction with the accompanying drawings.

DETAILED DESCRIPTION OF THE INVENTION

Figure 1:
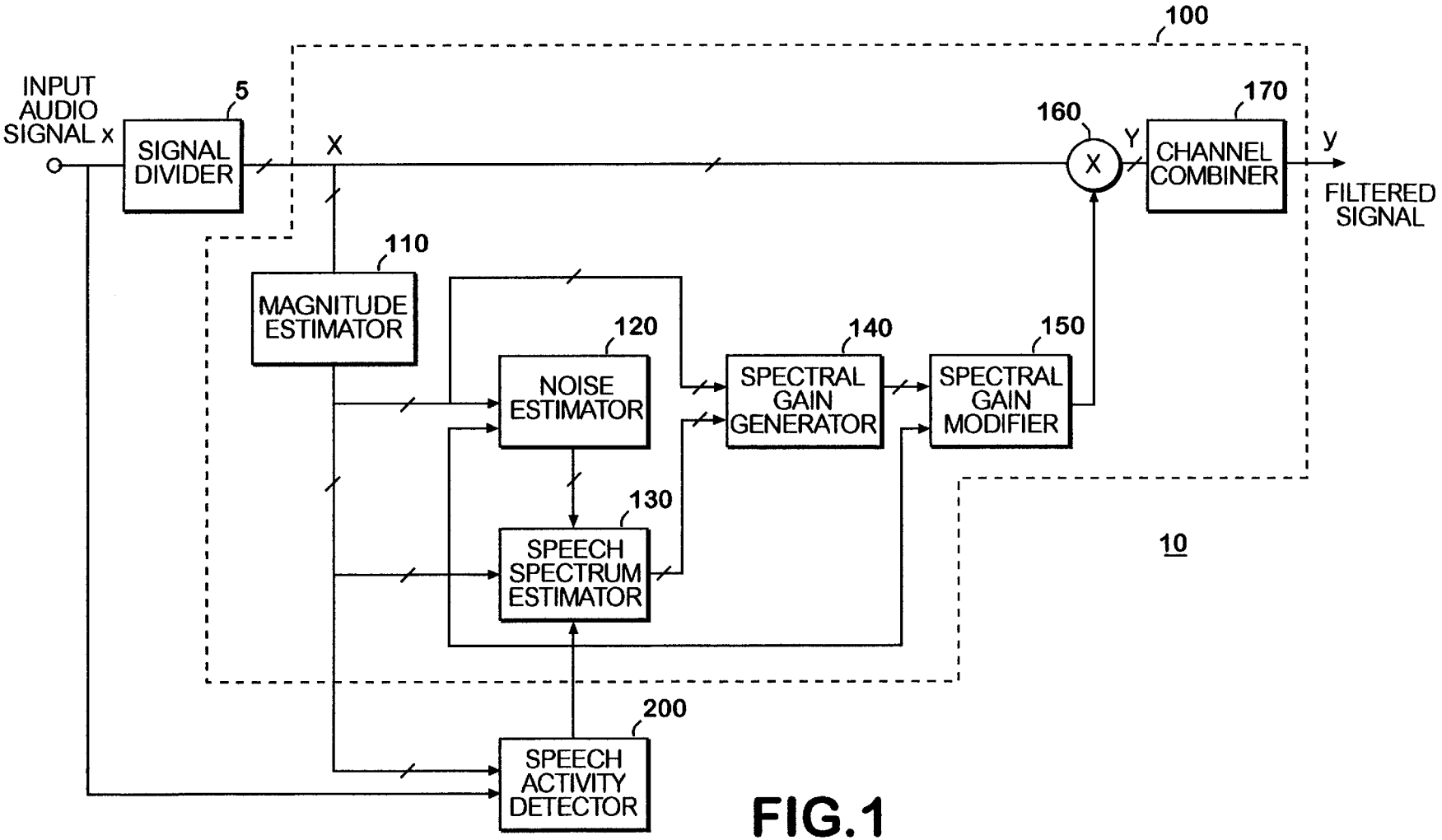
FIG. 1 is a block diagram showing the computation modules of a noise reduction system featuring a speech activity detector according to the present invention.

Referring first to FIG. 1, the noise reduction system according to the present invention is generally shown at reference numeral 10. There are two primary parts to the noise reduction system 10, an adaptive filter 100 and a voice or speech activity detector (VAD) 200. The adaptive filter 100 attenuates noise in the input signal. The VAD 200 determines when speech is present in a time frame of the input signal. Any VAD known in the art is suitable for use with the adaptive filter according to the present invention.

The adaptive filter 100 comprises a spectral magnitude estimator 110, a spectral noise estimator 120, a speech spectrum estimator 130, a spectral gain generator 140, a spectral gain modifier 150, a multiplier 160 and a channel combiner 170. The signal divider generates a spectral signal X, representing frequency spectrum information for individual time frames of the input signal, and divides this spectral signal for use in two paths. For simplicity, the term "spectral" is dropped in referring to the magnitude estimator 110 and spectral noise estimator 120 herein.

The VAD 200 may receive as input an output signal from the magnitude estimator 110 and the input signal x and it should generate as output a speech activity status signal that is coupled to several modules in the adaptive filter 100 as will be explained in more detail hereinafter. The speech activity status signal output by the AD 200 is used by the adaptive filter 100 to control updates of the noise spectrum and to set various time constants in the adaptive filter 100 that will be described below.

In the following discussion, the characteristics of the signals (variables) described are either scalar or vector. The index m is used to represent a time frame. All of the variables indexed by m only, e.g., [m], are scalar valued. All of the variables indexed by two variables, such as by [k; m] or [l, m], are vectors. When "l" (lower case "L") is used, it indicates indexing of a smoothed, sampled vector (in a preferred implementation the length of all of these is 16, though other lengths are suitable). The index k is used to represent the frequency band index (also called bins) values derived from or applied to each of the discrete Fourier transform (DFT) bins. Furthermore, in the figures, any line with a slash through it indicates that it is a vector.

The input signal, x, to the system 10 is a digitally sampled audio signal that is sampled at least 8000 samples per second. The input signal is processed in time frames and data about the input signal is generated during each time frame. It is assumed that the input signal x contains speech (or a related information bearing signal) and additive noise so that it is of the form $$x[n]=s[n]+n[n] \tag{1}$$

where s[n] and n[n] are speech (voice) and noise signals respectively and x[n] is the observed signal and system input. The signals s[n] and n[n] are assumed to be uncorrelated so their power spectral densities (PSDs) add as $$\Gamma_x(\omega)=\Gamma_s(\omega)+\Gamma_n(\omega) \tag{2}$$

where $\Gamma_s(\omega)$ and $\Gamma_n(\omega)$ are the PSDs of the speech and noise respectively. See, *Adaptive Filter Theory,* $2^{nd}$ ed., Prentice Hall, Englewood Cliffs, N.J. (1991) and *Discrete-Time Processing of Speech Signals,* Macmillan (1993).

A short term or single frame approximation of an ideal Wiener filter is given by $$H^{\dagger}(k;m)=\frac{\Gamma_s(k;m)}{\Gamma_s(k;m)+\Gamma_n(k;m)} \tag{3}$$

where k is the frequency band index and m is the frame index.

Since $\Gamma_s(k;m)$ and $\Gamma_n(k;m)$ are not known, they are estimated using the windowed discrete Fourier transform (DFT). The windowed DFT is given by $$X(k;m)=\sum_{n=0}^{N_w-1} w[n]\times[n-mN_f]e^{-i\frac{2\pi kn}{N_w}} \tag{4}$$

where $N_w$ is the window length, $N_f$ is the frame length, and w[n] is a tapered window such as the Hanning window given in Equation 5:

$$w[n]=\frac{1}{2}-\frac{1}{2}\cos\left(\frac{2\pi(n+1)}{N_w+1}\right) \tag{5}$$

The window length, $N_w$, is usually chosen so that $N_w \approx 2N_f$ and $0.008 \leqq N_w/F_s \leqq 0.032$ where $F_s$ is the sample frequency of x[n]. However, other window lengths are suitable and this is not intended to limit the application of the present invention.

The adaptive filter 100 will now be described in greater detail. The magnitude estimator 110 generates an estimated spectral magnitude signal based upon the spectral signal for individual time frames of the input signal. One technique known to be useful in generating the estimated spectral magnitude signal is based on the square root of the noise PSD. It is also possible to estimate the actual PSD and the system 100 described herein can work either way. The estimated spectral magnitude signal is a vector quantity and is coupled as input to the noise estimator 120, the speech spectrum estimator 130 and the spectral gain generator 140. The DFT derived PSD estimates are denoted with hats (^).

Figure 2:
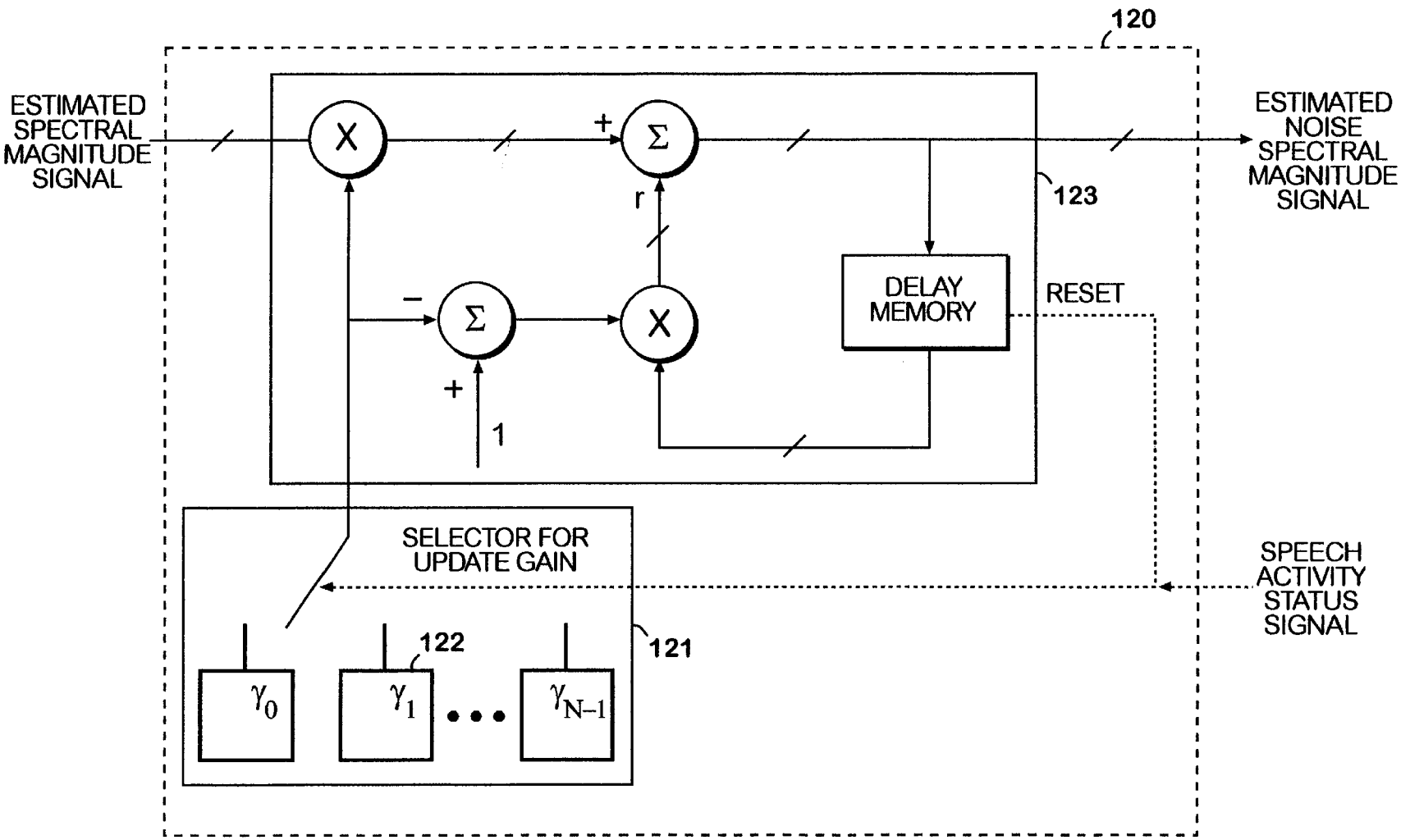
FIG. 2 is a block diagram of a noise estimator module.

The noise estimator 120 is shown in greater detail in FIG. 2. The noise estimator 120 comprises a computation module 123 and a selector module 121. The selector module 121 receives as input the speech activity status signal from the VAD 200 and generates a noise update factor $\gamma(m)$ that is usually fixed but during a reset of the VAD 200, it is changed to 0.0, then for about 100 msec following the reset, a lower-than-normal fixed value is set to allow for faster noise spectrum updates. The output of the noise estimator 120 is an estimated noise spectral magnitude signal $\Gamma_n^{1/2}(k;m)$ found according to the equations:

$$\Gamma_n^{\frac{1}{2}}(k;m) = \begin{cases} \max\left[\gamma(m)\Gamma_n^{\frac{1}{2}}(k;m-1) + (1-\gamma(m))\Gamma_x^{\frac{1}{2}}(k;m), 0\right] & \text{non-speech frame} \\ \Gamma_n^{\frac{1}{2}}(k;m-1) & \text{speech frame} \end{cases} \tag{6}$$

Figure 3:
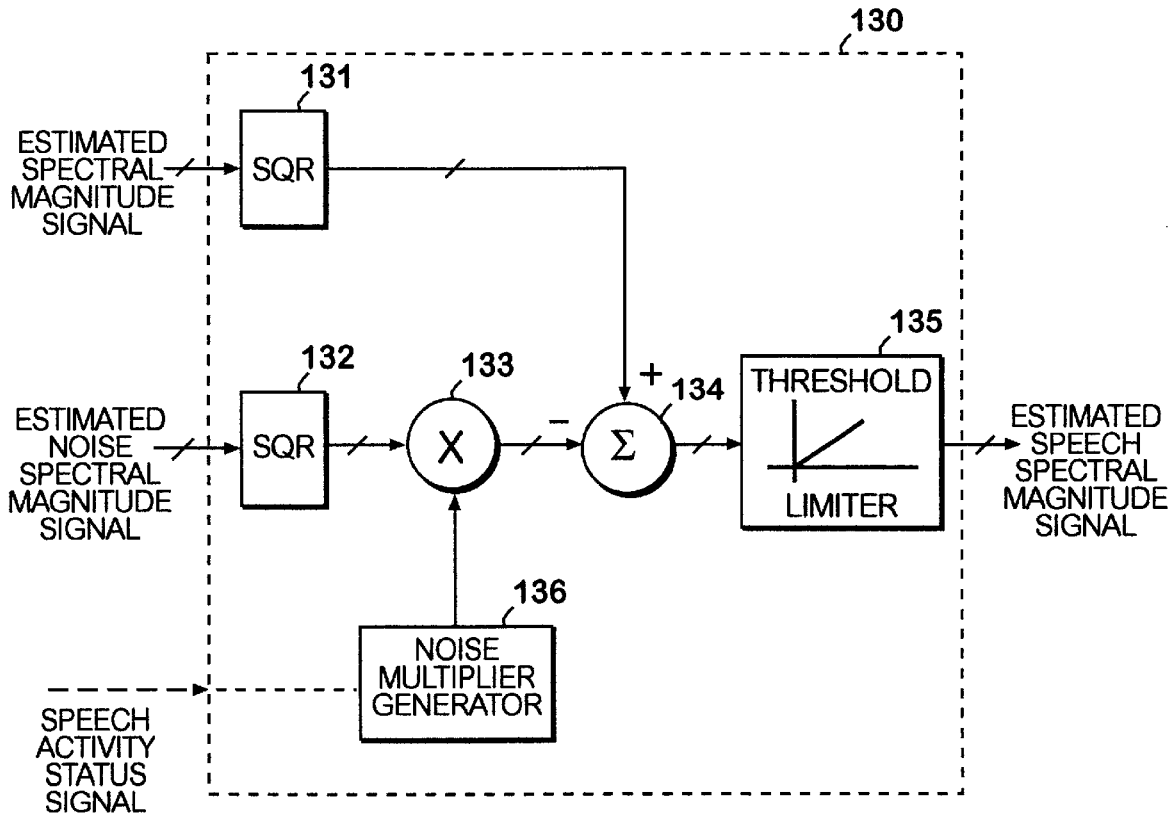
FIG. 3 is a block diagram of the speech spectrum estimator module.

The speech spectrum estimator 130 is shown in greater detail in FIG. 3. The speech spectrum estimator 130 comprises first and second squaring (SQR) computation modules 131 and 132. SQR module 131 receives the estimated spectral magnitude signal from the magnitude estimator 110 and SQR module 132 receives the noise estimate signal from the noise estimator 120. A noise multiplier generator 136 is provided and receives as input the speech activity status signal from the VAD 200. The noise multiplier generator 136 generates a value for a noise multiplier that is coupled to the multiplier 133, which in turn is coupled to an adder 134. The multiplier multiplies the (square of the) estimated noise spectral magnitude signal by the noise multiplier. The adder 134 adds the output of the SQR 131 and the output of the multiplier 133. The output of the adder is coupled to a threshold limiter 135. In essence, the estimated speech spectral magnitude signal is generated by subtracting from the estimated spectral magnitude signal a product of the noise multiplier and the estimated noise spectral magnitude signal. The output of the speech spectrum estimator 130 is the estimated speech spectral magnitude signal $\hat{\Gamma}_s(k;m)$:

$$\hat{\Gamma}_s(k;m)=\max[\hat{\Gamma}_x(k;m)-\mu(m)\hat{\Gamma}_n(k;m),0] \tag{7}$$

where $\hat{\Gamma}_x(k;m)=|X(k;m)|^2$, $\mu(m)$ is the noise multiplier generated by the noise multiplier generator 136. The noise multiplier $\mu(m)$ can also vary and is discussed in further detail below.

Equation (7) estimates the speech power spectrum by spectral subtraction as illustrated in FIG. 3. A common problem with spectral subtraction is that short-term spectral noise components may be greater than the estimated noise spectrum and are, therefore, not completely removed from the estimated speech spectrum. One way to reduce the residual noise components in the speech spectrum estimate is to subtract some multiple of the estimated noise spectrum—this is called oversubtraction or noise multiplication. Oversubtraction removes some of the speech, but nevertheless eliminates more of the noise resulting in fewer "musical noise" artifacts.

The noise multiplier, $\mu(m)$, in this implementation, varies according to the state of the VAD 200, that is, it varies depending on whether speech is present in a time frame. When no speech is present in a time frame of the input signal, it is desirable to reduce the noise as much as possible when estimating the speech spectrum. In this case a larger $\mu(m)$ is used. When speech is present in a time frame, it is important to not excessively reduce the speech, so a smaller $\mu(m)$ is used; this is especially important in colored noise having large spectral amplitudes coinciding with the speech spectrum. The value of the noise multiplier gradually changes from one value to another over about 4–6 frames. A typical range for the noise multiplier is $1.2 \leqq \mu(m) \leqq 2.5$.

Figure 4:
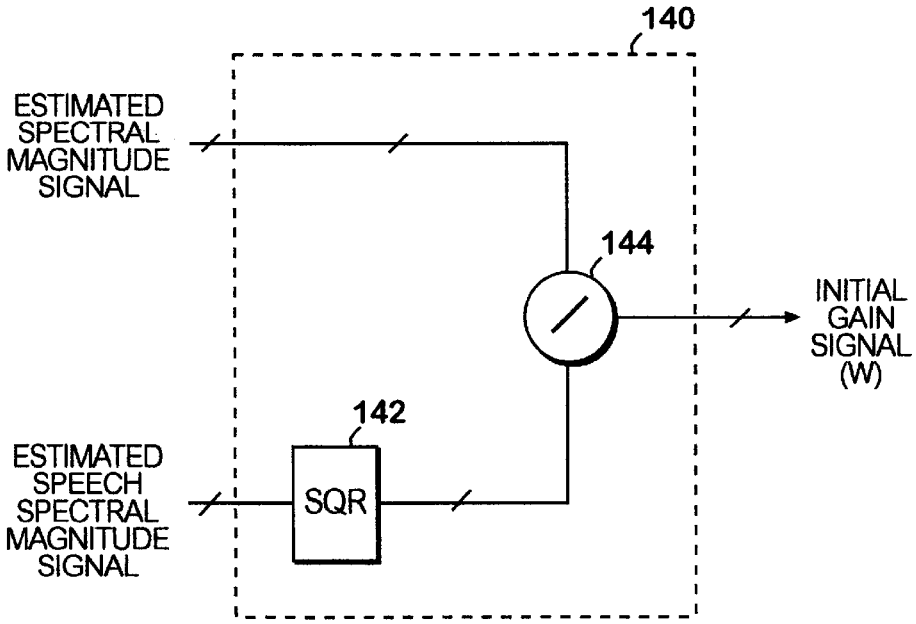
FIG. 4 is a block diagram of the spectral gain generator module.

The spectral gain generator 140 is shown in greater detail in FIG. 4. The spectral gain generator 140 comprises an SQR module 142 and a divider module 144. Given the estimated PSDs for noise and speech spectrum above, an estimate of the Wiener gain, $\hat{H}(k;m)$, of the optimal Wiener filter is obtained as $$\hat{H}(k;m) = \frac{\hat{\Gamma}_s(k;m)}{\hat{\Gamma}_x(k;m)} \tag{8}$$

Note that, for the denominator of $\hat{H}(k;m)$, $\hat{\Gamma}_x(k;m)$ is used in place of $\hat{\Gamma}_s(k;m)+\hat{\Gamma}_n(k,m)$, as indicated in FIG. 4. Thus, the initial spectral gain signal output by the spectral gain generator 140 is computed according to Equations 3, 4 and 5 above. In sum, the spectral gain generator receives as input the estimated spectral magnitude signal and the estimated speech spectral magnitude signal and generates as output an initial spectral gain signal that yields an estimate of speech spectrum in a time frame of the input signal when the initial spectral gain signal is applied to the spectral signal (output by the signal divider 5).

Figure 5:
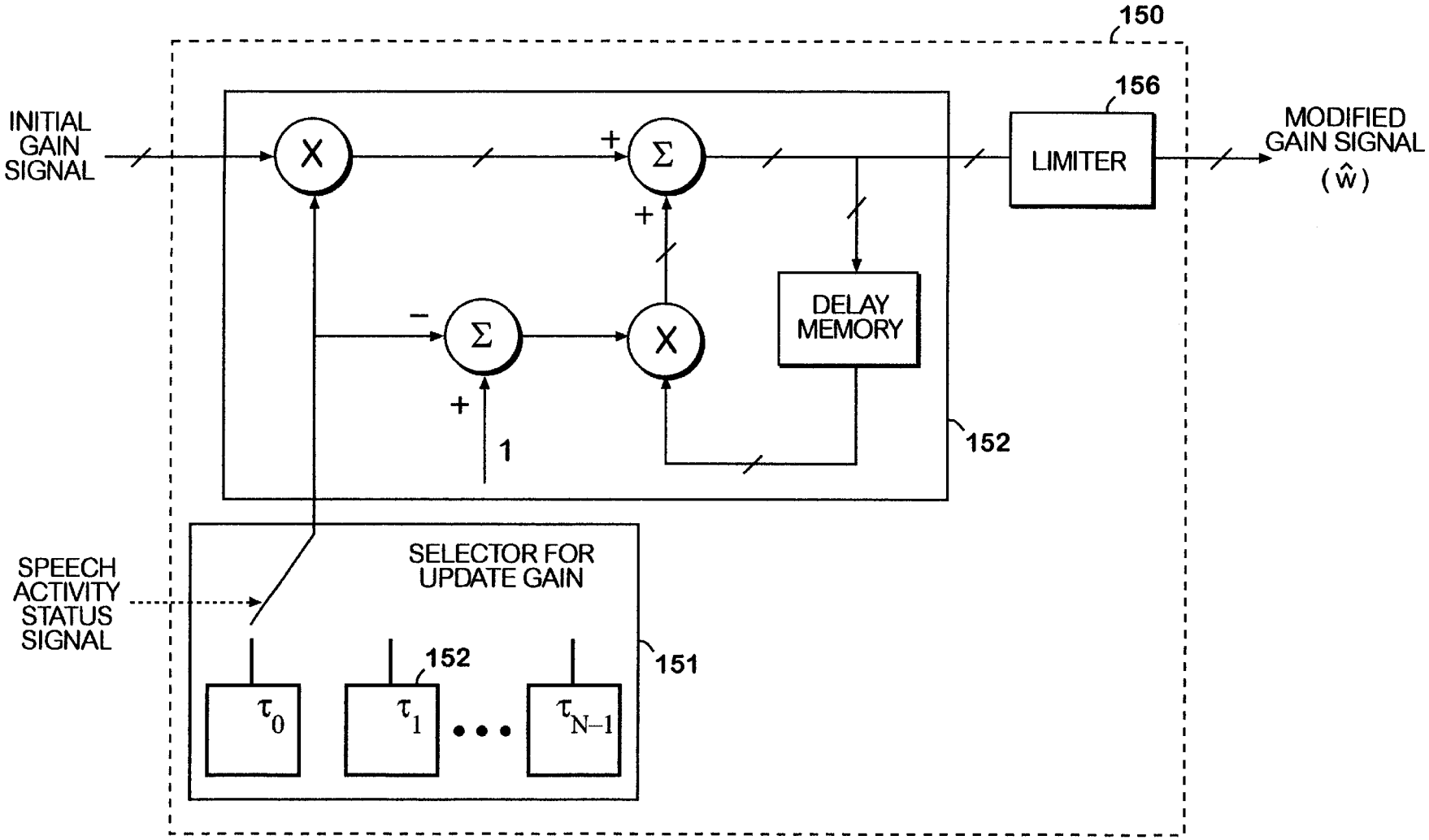
FIG. 5 is a block diagram of the spectral gain modifier module.

Turning to FIG. 5, the spectral gain modifier 150 will be described. Since $\hat{H}(k;m)$ is based on estimates of the PSDs, it will have errors. These errors can cause (very) audible distortion in the processed signal; therefore, $\hat{H}(k;m)$ is averaged with previous frames to improve the filter estimate and to generate a modified gain signal. The spectral gain modifier 150 comprises a computation module 152 and a limiter 156. The modified spectral gain signal, i.e., the "smoothed" Wiener filter, H(k;m), is given by $$H(k;m)=\max[\tau(m)H(k;m-1)+(1-\tau(m)\hat{H}(k;m),L] \tag{9}$$

where L is the attenuation limit implemented in the limiter 156, and $\tau(m)$ is a correction factor provided by the correction module 151. The correction factor $\tau(m)$ depends on the whether speech is present in a time frame, as indicated by the state of the VAD 200. For non-speech frames, the filter evolves more slowly than during speech frames. Typical choices for $\tau(m)$ in correction module 151 are $$\tau(m) = \begin{cases} 0.7 & \text{speech frames} \\ 0.85 & \text{non-speech frames} \\ 0 & \text{reset frames} \end{cases} \quad (10)$$

In sum, the spectral gain modifier 150 receives as input the initial spectral gain signal and generates a modified spectral gain signal by limiting a rate of change of the initial spectral gain signal with respect to the spectral gain over a number of prior time frames.

Referring again to FIG. 1, in the adaptive filter 100, the modified spectral gain signal is coupled to the multiplier 160. The multiplier 160 multiplies the spectral signal, X, by the modified spectral gain signal to generate a speech spectrum signal (with added noise removed). The speech spectrum signal, Y, is then coupled to the channel combiner 170. The channel combiner 170 performs an inverse operation of the signal divider 5 to convert the frequency-based speech spectrum signal y to a time domain speech signal y. For example, if the signal divider 5 employs a DFT operation, then the channel combiner 170 performs an inverse DFT operation with overlap/add synthesis since the DFT operates on overlapping blocks, that is, the window length is longer than the frame length of frame skip.

There are several aspects of the system and method according to the present invention that contribute to its successful operation and uniqueness. First, the spectral gain is adaptively smoothed over time as a function of the stationarity of the speech and noise. This is implemented by simply changing the filter averaging based on the output of the VAD. This approach to implementing stationarity-based filter smoothing is successful because VAD states typically change primarily based on the energy and stationarity of the signal. Second, an adaptive noise multiplier is used for estimating the speech spectrum prior to the spectral gain calculation. The noise multiplier is adapted based on the VAD state. This provides the benefits of severe oversubtraction for noise reduction during noise only periods while avoiding the artifacts and attenuation problems associated with severe oversubtraction during speech frames.

This system and method according to the present invention is an improvement over other noise reduction systems in that it is simple, introduces only a small delay between input and output, and is computationally efficient while providing a means for reducing musical noise artifacts. The system and method according to the present invention also improves the amount of background noise reduced during non-speech periods without increasing the distortion of the speech signal. The noise reduction system is computationally efficient and well suited for implementation using a digital signal processor with a variety of signal sample rates.

In addition, the system is designed to work with a range of analysis window lengths and sample rates. Moreover, the system is adaptable in the amount of noise it removes, i.e. it can remove enough noise to make the noise only periods silent or it can leave a comfortable level of noise in the signal which is attenuated but otherwise unchanged. The latter is the preferred mode of operation. The system is very efficient and can be implemented in real-time with only a few MIPS at lower sample rates. The system is robust to operation in a variety of noise types. It works well with noise that is white, colored, and even noise with a periodic component. For systems with little or no noise there is little or no change to the signal, thus minimizing possible distortion.

The system and methods according to the present invention can be implemented in any computing platform, including digital signal processors, application specific integrated circuits (ASICs), microprocessors, etc.

In summary, the present invention is directed to an adaptive filter for removing noise from an input signal comprising a digitally sampled audio signal containing speech and added noise, the adaptive filter comprising: a signal divider for generating a spectral signal representing frequency spectrum information for individual time frames of the input signal; a magnitude estimator for generating an estimated spectral magnitude signal based upon the spectral signal for individual time frames of the input signal; a speech spectrum estimator receiving as input the estimated spectral magnitude signal for a time frame and generating an estimated speech spectral magnitude signal representing estimated spectral magnitude values for speech in a time frame; a spectral gain generator that receives as input the estimated spectral magnitude signal and the estimated speech spectral magnitude signal and generates as output an initial spectral gain signal that yields an estimate of speech spectrum in a time frame of the input signal when the initial spectral gain signal is applied to the spectral signal; a spectral gain modifier that receives as input the initial spectral gain signal and generates a modified gain signal by limiting a rate of change of the initial spectral gain signal with respect to the spectral gain over a number of previous time frames; a multiplier for multiplying the spectral signal by the modified gain signal to generate a speech spectrum signal; and a channel combiner coupled to the multiplier for converting the speech spectrum signal to a time domain speech signal.

Similarly, the present invention is directed to a method of removing noise an input signal comprising a digitally sampled audio signal containing speech and added noise, comprising steps of: generating a spectral signal that represents frequency spectrum information for individual time frames of the input signal; generating an estimated spectral magnitude signal for each time frame based upon the spectral signal; generating an estimated speech spectral magnitude signal representing estimated spectral magnitude values for speech in a time frame based upon the estimated spectral magnitude signal; generating an initial spectral gain signal that yields an estimate of speech spectrum in a time frame of the input signal when the initial spectral gain signal is applied to a spectral signal; limiting a rate of change of the initial spectral gain signal with respect to the spectral gain over a number of previous time frames to generate a modified gain signal; multiplying the spectral signal by the modified gain signal to generate as output a speech spectrum signal; and converting the speech spectrum signal to a time domain speech signal.

In addition, the present invention is directed to a system and method for filtering an input signal comprising a digitally sampled audio signal containing speech and added noise, the method comprising steps of: generating an estimated spectral magnitude signal representing frequency spectrum information for individual time frames of the input signal; generating an estimated noise spectral magnitude signal representing average spectral magnitude values for noise in a time frame of the input signal based on the estimated spectral magnitude signal; generating an estimated speech spectral magnitude signal in a time frame of the input signal by subtracting from the estimated spectral magnitude signal a product of a noise multiplier and the estimated noise spectral magnitude signal; and controlling the value of the noise multiplier based on a measure of whether speech is present in a time frame. The step of controlling is such that the value of the noise multiplier is a larger value when a time frame of the input signal contains more noise than speech and is a smaller value for the noise multiplier when a time frame of the input signal contains more speech than noise.

This system and method according to the present invention is an improvement over other noise reduction systems in that it is simple, introduces only a small delay between input and output, and is computationally efficient while providing a means for reducing musical noise artifacts. The system and method according to the present invention also improves the amount of background noise reduced during non-speech periods without increasing the distortion of the speech signal. The noise reduction system is computationally efficient and well suited for implementation using a digital signal processor with a variety of signal sample rates. Also, the speech activity detector associated with the system is effective in a variety of noise conditions and it is able to recover quickly from errors due to abrupt changes in the noise background.

In addition, the system is designed to work with a range of analysis window lengths and sample rates. Moreover, the system is adaptable in the amount of noise it removes, i.e. it can remove enough noise to make the noise only periods silent or it can leave a comfortable level of noise in the signal which is attenuated but otherwise unchanged. The latter is the preferred mode of operation. The system is very efficient and can be implemented in real-time with only a few MIPS at lower sample rates. The system is robust to operation in a variety of noise types. It works well with noise that is white, colored, and even noise with a periodic component. For systems with little or no noise there is little or no change to the signal, thus minimizing possible distortion.

The system and methods according to the present invention can be implemented in any computing platform, including digital signal processors, application specific integrated circuits (ASICs), microprocessors, etc.

The above description is intended by way of example only and is not intended to limit the present invention in any way except as set forth in the following claims.

We claim:

1. An adaptive filter for removing noise from an input signal comprising a digitally sampled audio signal containing speech and added noise, the adaptive filter comprising:

a signal divider for generating a spectral signal representing frequency spectrum information for individual time frames of the input signal;

a magnitude estimator for generating an estimated spectral magnitude signal based upon the spectral signal for individual time frames of the input signal;

a speech spectrum estimator receiving as input the estimated spectral magnitude signal for a time frame and generating an estimated speech spectral magnitude signal representing estimated spectral magnitude values for speech in a time frame;

a spectral gain generator that receives as input the estimated spectral magnitude signal and the estimated speech spectral magnitude signal and generates as output an initial spectral gain signal that yields an estimate of speech spectrum in a time frame of the input signal when the initial spectral gain signal is applied to the spectral signal;

a spectral gain modifier that receives as input the initial spectral gain signal and generates a modified gain signal by limiting a rate of change of the initial spectral gain signal with respect to the spectral gain over a number of previous time frames;

a multiplier for multiplying the spectral signal by the modified gain signal to generate a speech spectrum signal;

a channel combiner coupled to the multiplier for converting the speech spectrum signal to a time domain speech signal; and a speech activity detector that generates an output which indicates that speech is either present during a time frame or not present during a time frame, and wherein the spectral gain modifier limits to a greater degree the rate of change of the initial spectral gain signal during time frames for which speech activity detector output indicates that speech is not present as opposed to time frames during which the speech activity detector output indicates that speech is present.

2. The noise reduction system of claim 1, wherein the spectral gain modifier limits to a greater degree the rate of change of the initial spectral gain signal during time frames for which spectral characteristics of the input signal are slowly changing as opposed to time frames during which spectral characteristics of the input signal are changing quickly.

3. The noise reduction system of claim 1, and further comprising a noise estimator receiving as input the estimated spectral magnitude signal and generating as output an estimated noise spectral magnitude signal for a time frame, the estimated noise spectral magnitude signal representing average spectral magnitude values for noise in a time frame;

wherein the speech spectrum estimator generates the estimated speech spectral magnitude signal by subtracting from the estimated spectral magnitude signal a product of a noise multiplier and the estimated noise spectral magnitude signal, wherein the speech spectrum estimator controls the value of the noise multiplier based on a measure of whether speech is present in a time frame.

4. The noise reduction system of claim 3, wherein the speech spectrum estimator generates a larger value for the noise multiplier when a time frame of the input signal contains more noise than speech and generates a smaller value for the noise multiplier when a time frame of the input signal contains more speech than noise.

5. A method of removing noise from an input signal comprising a digitally sampled audio signal containing speech and added noise, comprising steps of:

generating a spectral signal that represents frequency spectrum information for individual time frames of the input signal;

generating an estimated spectral magnitude signal for each time frame based upon the spectral signal;

generating an estimated speech spectral magnitude signal representing estimated spectral magnitude values for speech in a time frame based upon the estimated spectral magnitude signal;

generating an initial spectral gain signal that yields an estimate of speech spectrum in a time frame of the input signal when the initial spectral gain signal is applied to a spectral signal;

limiting a rate of change of the initial spectral gain signal with respect to the spectral gain over a number of previous time frames to generate a modified gain signal by limiting to a greater degree the rate of change of the initial spectral gain signal during time frames for which spectral characteristics of the input signal are relatively slowly changing as opposed to time frames during which spectral characteristics of the input signal are relatively quickly changing;

multiplying the spectral signal by the modified gain signal to generate as output a speech spectrum signal; and converting the speech spectrum signal to a time domain speech signal.

6. The method of claim 5, and further comprising the step of generating an estimated noise spectral magnitude signal representing average spectral magnitude values for noise in a time frame, wherein the step of generating the estimated speech spectrum magnitude signal comprises subtracting from the estimated spectral magnitude signal a product of a noise multiplier and the estimated noise spectral magnitude signal, wherein the value of the noise multiplier is based on a measure of whether speech is present in a time frame.

7. The method of claim 6, and further comprising the step of generating a larger value for the noise multiplier when a time frame of the input signal contains more noise than speech and generating a smaller value for the noise multiplier when a time frame of the input signal contains more speech than noise.

* * * * *